US005352138A

United States Patent [19]

Kanno

[11] Patent Number: 5,352,138

[45] Date of Patent: Oct. 4, 1994

[54] REMOTE CONTROL SYSTEM FOR OUTBOARD DRIVE UNIT

[75] Inventor: Isao Kanno, Hamamatsu, Japan

[73] Assignee: Sanshin Kogyo Kabushiki Kaisha, Hamamatsu, Japan

[21] Appl. No.: 845,237

[22] Filed: Mar. 3, 1992

[30] Foreign Application Priority Data

Mar. 6, 1991 [JP] Japan ..... 3-065475

[51] Int. Cl.[5] ..... B60K 41/04

[52] U.S. Cl. ..... 440/1; 74/480 B; 440/86; 440/87

[58] Field of Search ..... 440/1, 84, 87, 86; 74/480 B, DIG. 8

[56] References Cited

U.S. PATENT DOCUMENTS

| | | |
|---|---|---|
| 2,702,615 | 2/1955 | Morse . |
| 2,869,861 | 11/1959 | Carlson . |
| 3,322,994 | 5/1967 | Dever et al. . |
| 3,644,816 | 2/1972 | Gilbert . |
| 4,004,537 | 1/1977 | Nilsson . |
| 4,020,713 | 5/1977 | Cantley et al. . |
| 4,079,906 | 3/1978 | Durandeau et al. . |
| 4,223,624 | 9/1980 | Iyeta . |
| 4,306,314 | 12/1981 | Griffiths . |
| 4,513,235 | 4/1985 | Acklam et al. . |
| 4,527,983 | 7/1985 | Booth . |
| 4,614,900 | 9/1986 | Young . |
| 4,718,869 | 1/1988 | Fisher . |
| 4,810,216 | 3/1989 | Kawamura . |
| 4,824,408 | 4/1989 | Aertker et al. . |
| 4,831,531 | 5/1989 | Adams et al. . |
| 4,836,809 | 6/1989 | Pelligrino . |
| 4,914,368 | 4/1990 | Orton . |
| 4,919,005 | 4/1990 | Schleicher . |
| 4,920,819 | 5/1990 | Uchida et al. . |
| 5,029,547 | 7/1991 | Novey . |
| 5,056,379 | 10/1991 | den Ouden ..... 74/480 B |
| 5,058,793 | 10/1991 | Neville et al. . |
| 5,072,361 | 12/1991 | Davis et al. . |
| 5,094,122 | 3/1992 | Okita ..... 440/87 |
| 5,214,977 | 6/1993 | Nagafusa ..... 440/84 |
| 5,216,934 | 6/1993 | Iwasaki ..... 74/480 B |

*Primary Examiner*—Michael S. Huppert
*Assistant Examiner*—Thomas J. Brahan
*Attorney, Agent, or Firm*—Knobbe, Martens, Olson & Bear

[57] ABSTRACT

A remote control system for transmitting control movement to a throttle and transmission actuator of an outboard drive unit having an engine. The system preferably includes two remote control units each having an operator that is movable between a plurality of positions and is mechanically connected to an actuator unit. A transmitter wire mechanically connects the actuator unit to the throttle actuator for actuating it to open or close the throttle valve(s) of the engine in response to movement of a selected one of the operators. A position detector detects the position of the selected operator and another position detector detects the position of the transmission actuator and each detector outputs a signal to a controlling unit indicative of its detection result. An electric motor driven actuator is electrically connected to the controlling unit and is operated to effect movement of the transmission actuator when the signals outputted by the position detectors are not in agreement. An interrupt circuit is also electrically connected to the controlling unit and is activated to interrupt the operation of the engine if the position of the selected operator has changed and if the engine speed is determined to be greater than 1000 rpm for maintaining a relatively low engine speed during gear shifting operation.

12 Claims, 8 Drawing Sheets

REMOTE CONTROL SYSTEM FOR OUTBOARD DRIVE UNIT

BACKGROUND OF THE INVENTION

This invention relates to a remote control system, and more particularly to an improved remote control system of the type which includes an operator which is adapted to be employed for mechanically operating the throttle of an outboard drive unit and for operating the transmission of the drive unit through an electric motor that is driven on the basis of an electrical signal indicative of the position of the operator and which provides a smooth shifting operation even when the operator is abruptly moved.

Purely mechanical remote control systems have been provided which utilize wire cables and mechanical actuator units to connect the remote operator with a pair of controlled members, such as a throttle and shift actuator, on an outboard drive unit. These types of fully mechanical systems are generally satisfactory for use in smaller watercraft. However, such systems have certain disadvantages when they are used larger watercraft where the distance between the remote operator near the driver's seat and the outboard drive unit itself can be relatively long. The reason for this is that the frictional resistance in the system and operating load imposed on the operator are increased as the length of the cables are increased to accommodate these greater distances. As a result, it is more difficult to effect movement of the throttle and shift actuators over greater distances using purely mechanical systems.

Therefore, a type of remote control system has been proposed wherein the throttle actuator is mechanically connected to the operator while the shift actuator is driven by an electric motor in response to an electrical signal that is indicative of the position of the remote operator. An example of such a system is provided in Japanese Patent Application 2-210228.

Although this type of system decreases the frictional resistance in the system and operating load on the operator, it has certain disadvantages if the operator is moved abruptly. For example, when the operator is suddenly shifted to a forward or reverse position from the neutral position, there will be some time delay before the shift actuator on the outboard drive unit will be actuated. This is due to the time required for processing the electrical signal and actuating the electric motor in response to the operator movement. On the other hand, the throttle actuator, which is mechanically connected to the operator, will be actuated immediately in response to the abrupt movement of the operator. When this occurs, the engine speed will rise while the shift actuator is still in neutral. In fact, by the time the electric motor is actuated to effect movement of the shift actuator, it is likely that the engine speed will have risen to a speed high enough to make it very difficult to bring the shift actuator into gear. Even if the shifting can be accomplished at such a high engine speed, it will usually be a very rough transition and will be accompanied by an abrupt change in engine speed when the drive unit is put in gear.

It is, therefore, a principal object of this invention to provide an improved remote control system which provides for smooth shifting even when the operator of the system is abruptly moved.

SUMMARY OF THE INVENTION

This invention is adapted to be embodied in a remote control system for transmitting control movement to at least two controlled members, preferably a throttle and transmission actuator, of an outboard drive unit which includes an engine. The system includes an actuator unit, a remote control unit having an operator movable between a plurality of positions and mechanically connected to the actuator unit, and a transmitter mechanically connecting the actuator unit to one of the controlled members, preferably the throttle actuator, for actuating it in response to movement of the operator. Means are provided for detecting the position of the operator and outputting a signal to a controlling unit indicative of the detected position of the operator. The system further includes electric actuating means electrically connected to the controlling unit for actuating the other controlled member, preferably the transmission actuator, on the basis of the signal received by the controlling unit. In accordance with the invention, engine speed restraining means is electrically connected to the controlling unit for interrupting the engine operation when the engine speed is determined to be greater than a predetermined value and when the signal outputted by the detecting means indicates a change in the position of the operator.

DETAILED DESCRIPTION OF THE PREFERRED EMBODIMENTS OF THE INVENTION

Figure 1:
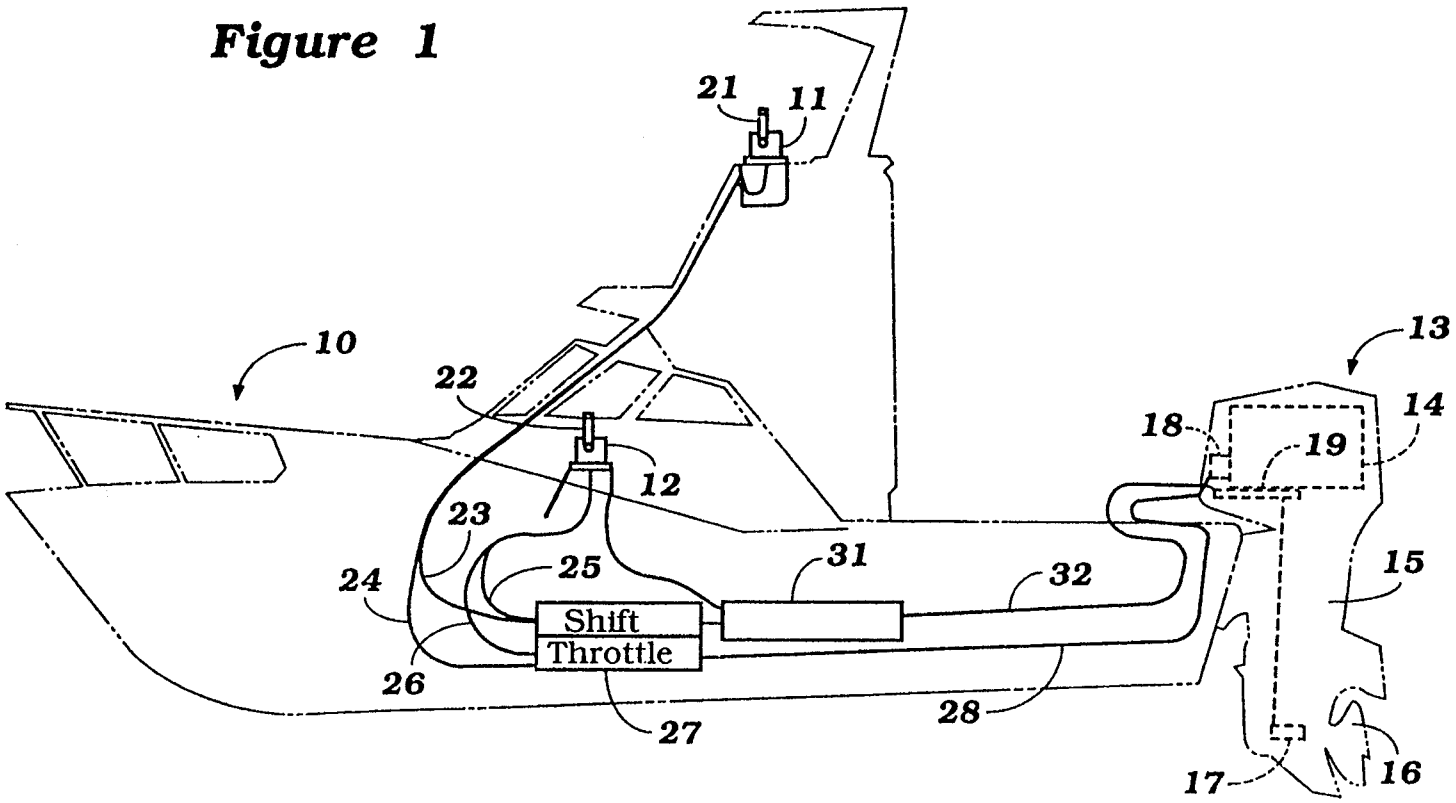
FIG. 1 is partially perspective and partially schematic view of the remote control system for an outboard drive unit and associated watercraft constructed in accordance with an embodiment of the invention.

Referring first to FIG. 1, a remote control system for operating an outboard drive unit from either of two remote locations is depicted. One remote control unit, indicated by the reference numeral 11, is positioned on the bridge and the other control unit, indicated by the reference numeral 12, is located in the cabin of a watercraft that is designated generally by the reference numeral 10. It should be noted that the remote control units 11 and 12 may positioned within the watercraft 10 at locations other than the bridge and cabin and in fact the system may be adapted for use with only a single remote control unit. Either of the remote control units 11 or 12 may be selected independently of the other for controlling the outboard drive unit, identified generally by the reference numeral 13. The outboard drive unit 13 may comprise either an outboard motor as shown in FIG. 1 or the outboard drive portion of an inboard/outboard drive unit.

In the illustrated embodiment, the outboard drive unit 13 is in the form of an outboard motor that includes a power head containing an internal combustion engine 14 which is surrounded by a protective cowling. The internal combustion engine 14 drives an output shaft which, in turn, drives a drive shaft that is journaled for rotation within a drive shaft housing 15 that depends from the power head. This drive shaft (not shown) drives a propeller 16 that is affixed to a propeller shaft of a lower unit by means of a conventional forward, neutral, reverse transmission of the type used with such drive units. This transmission includes a dog clutching element 17 for selectively engaging the propeller shaft with the drive shaft for either forward or reverse rotation and for selectively disengaging the propeller shaft from the drive shaft when the transmission is in neutral.

A throttle control actuator 18 is positioned on the engine 14 of the drive unit 13 and is adapted to control the speed of the engine 14 in a known manner. In addition, a transmission control actuator 19 is also positioned on the outboard drive unit 14 and is designed to operate the transmission. These throttle and transmission control actuators 18 and 19 or controlled members are actuated by either of the remote control units 11 or 12 in a manner to be described.

Figure 2:
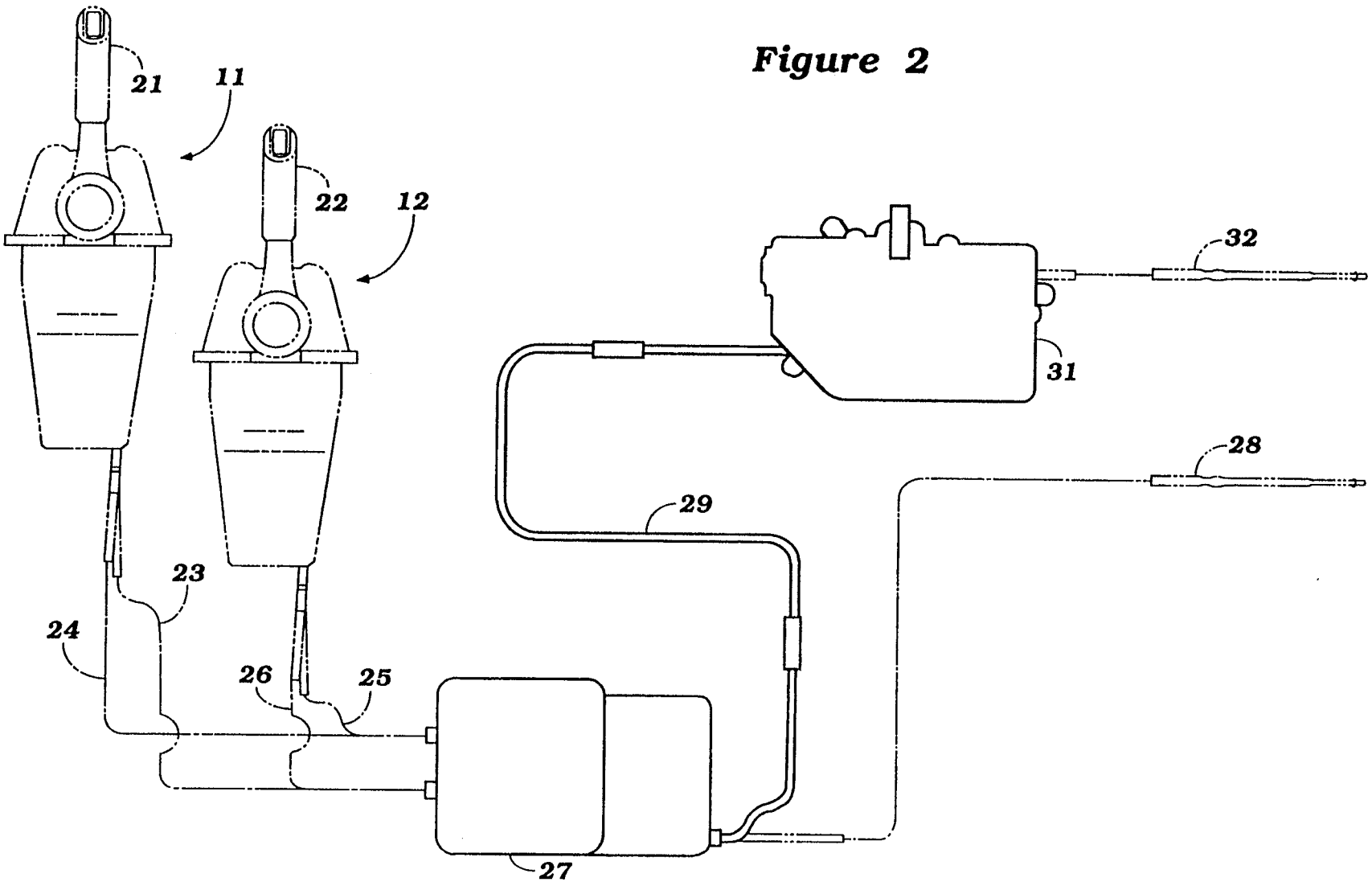
FIG. 2 is a partially perspective view showing a pair of remote control units and their respective operators, as well as the actuator unit and driving unit of the remote control system.

Referring now to FIG. 2, in addition to FIG. 1, each of the remote control units 11 and 12 is respectively comprised of a transmission-throttle control operator 21 or 22, one or the other of which may be selected for actuation of the throttle and transmission levers 18 and 19. The transmission-throttle control operators 21 and 22 are each movable between a neutral position, as shown in FIG. 2, and forward drive and reverse drive positions. The throttle opening is progressively increased as either of these operators 21 or 22 is moved further forward or further in reverse from the neutral position.

The operator 21 has a pair of bowden wire cables connected to it, one wire 23 for actuation of the transmission actuator 19 and the other wire 24 for actuation of the throttle control lever 18 of the outboard drive unit 13. In a like manner, a bowden wire actuator 25 is connected to the operator 22 for actuation of the transmission control lever 19, and a bowden wire 26 is connected to the operator 22 for actuation of the throttle control lever 18. The bowden wire cables 24 and 26 are connected at their other ends to an actuator unit, identified generally by the reference numeral 27, for actuation of a bowden wire of cable 28 that is connected to the throttle control lever 18 in a manner to be described. The other ends of bowden wire cables 23 and 25 are also connected to the actuator unit 27. However, in this instance, movement of these cables 23 and 25 results in an electrical signal being transmitted from the actuator unit 27 through a wire harness 29 to a driving unit, identified generally by the reference numeral 31, for actuation of a shift bowden wire of cable 32 that is directly connected to the transmission control lever 19. The bowden wire cables 23, 24, 25 and 26 are each slidably supported within an outer wire cover that is affixed at one end to the appropriate remote control unit 11 or 12 and at the other end to the outer casing of the actuator unit 27 as shown in FIG. 3.

Figure 3:
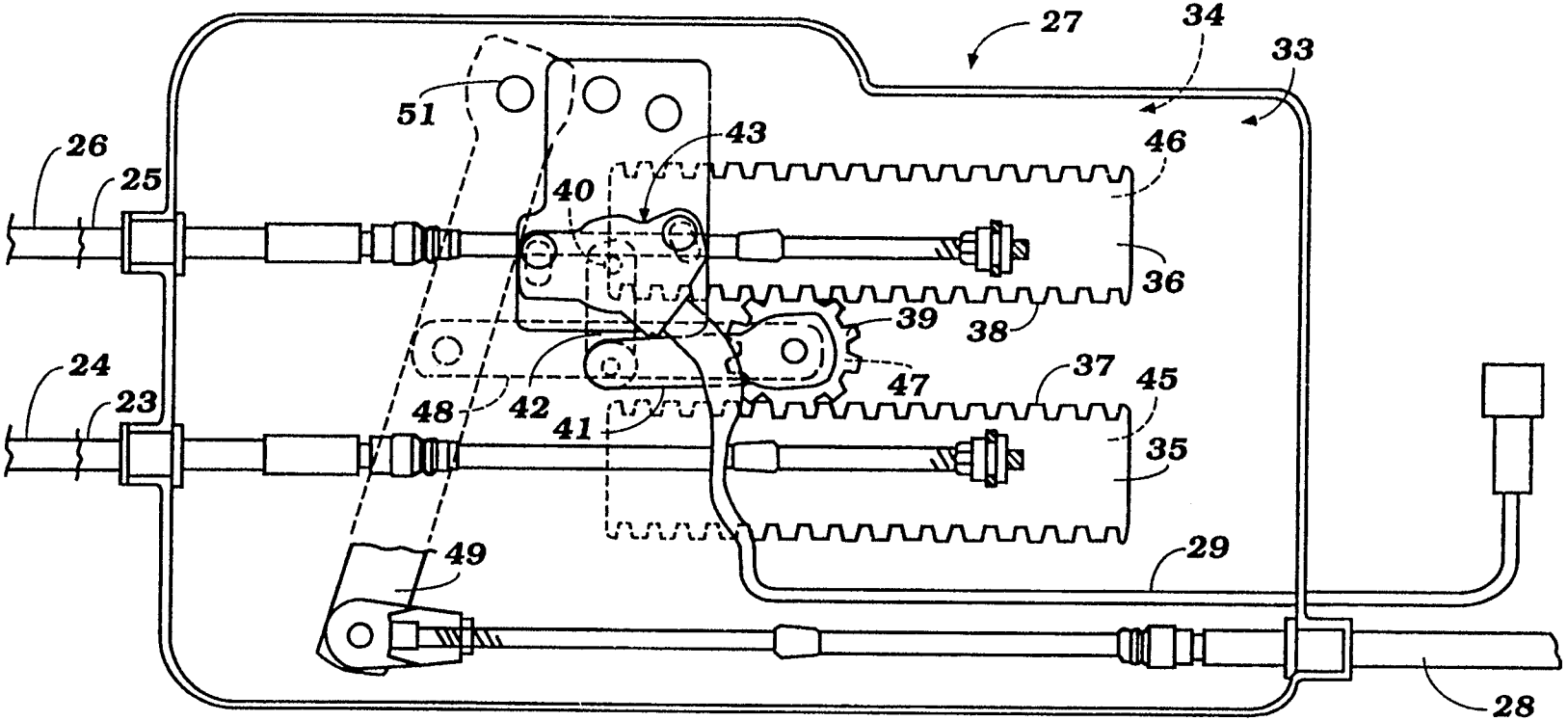
FIG. 3 is an enlarged sectional view of the actuator unit.

Referring now more specifically to FIG. 3, the construction of the actuator unit 27 is illustrated. The interior of the outer casing of the actuator unit 27 is divided into two chambers, a front chamber 33 where the mechanism for adjusting the shift lever 19 is accommodated and a rear chamber 34 where the throttle lever adjusting mechanism is positioned. The shift bowden wires 23 and 25 are respectively connected to lower and upper slide racks 35 and 36 which are slidably supported on guides within the front chamber 33 of the actuator unit 27. The slide racks 35 and 36 each have teeth 37 and 38 which are integrally formed on oppositely facing sides and which are enmeshed with a pinion gear 39 that is connected for rotation with a shaft. A first connecting link 41 is rotatably attached at one end to the pinion gear shaft and is pivotally connected at its other end to a second connecting link 42 that interconnects the first link 41 with a position detector 43. In the illustrated embodiment, the detector 43 includes a potentiometer that converts the angular rotation of a pin 40, connecting the detector 43 with the second link 42, into a voltage which is indicative of the degree of rotation the pin 40 and which also corresponds to a particular position of slide rack 35 and operator 21 or slide rack 36 and operator 22. This voltage is then transmitted by the position detector 43 as an electrical signal through the wire harness 29 to a controlling unit 44 where the voltage signal is processed as hereinafter described.

The throttle bowden wires 24 and 26 are also connected to lower and upper slide racks, identified by the reference numerals 45 and 46 respectively. These slide racks 45 and 46 are slidably supported on guides within the rear chamber 34 of the actuator unit 27. Each of these slide racks 45 and 46 has a set of teeth which are enmeshed with a pinion gear 47 that is interposed between the two slide racks 45 and 46 and supported on a shaft. A link 48 is connected at one end to the shaft of the pinion gear 47 and at its other end to the midpoint of a lever arm 49 that is pivotally supported at one end within the actuator unit 27 by means of shaft 51. The other end of the lever arm 49 is connected to the inner wire of cable 28 for actuation of the throttle lever 18. The outer cover of cable 28 is connected to the casing of the actuator unit 27 as shown in FIG. 3.

Figure 4:
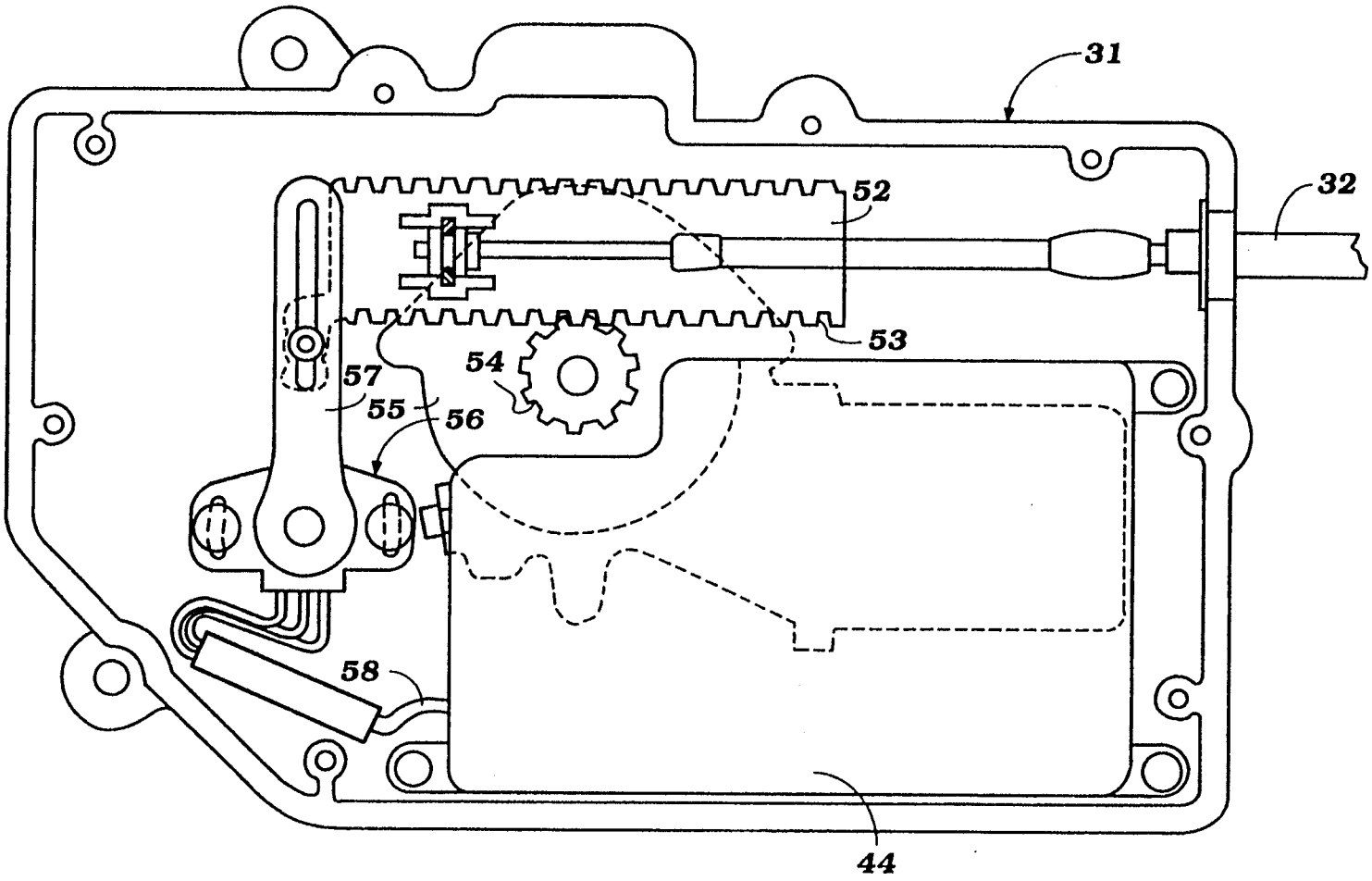
FIG. 4 is an enlarged sectional view of the driving unit.

Referring now to FIG. 4, the details of the driving unit 31 are shown. The driving unit 31 is used to actuate the shift lever 19 through movement of the inner wire of shift cable 32. The outer cover of cable 32 is affixed to the outer casing of the driving unit 31 while the inner wire of cable 32 extends through the casing for connection to a slide rack 52 of the driving unit 31. This slide rack 52 is slidably supported on a guide and has teeth 53 on its upper and lower sides, the lower teeth being in constant mesh under normal conditions with a pinion gear 54 that is rotatably journaled on a shaft. An electric motor driven actuator 55 is drivingly coupled to that shaft to effect movement of the slide rack 52 and hence the shift actuator 19 based on electrical signals received by the controlling unit 44 from the position detector 43 and from a second position detector 56 of the driving unit 31.

In the illustrated embodiment, the position detector 56 is comprised of a potentiometer and further includes an arm 57 having a slot which is adapted to receive a pin for connection to the end of the slide rack 52 opposite its connection to the inner wire of shift cable 32. The potentiometer of the detector 56 converts the rotational position of the arm 57 which corresponds to a particular position of the slide rack 52 and hence to a particular position of the shift actuator 19 into a voltage. The position detector 56 then transmits a voltage signal to the controlling unit 44 through an electrical lead 58.

The manner in which the remote control system operates to control the throttle and shift actuators 18 and 19 on the outboard drive unit 13 will now be described with reference to FIGS. 1–4 as well as to FIG. 5 which illustrates the relationship between the controlling unit 44 and various input sensors including the position detectors 43 and 56. When the operator 21 is moved from its neutral position to a forward or reverse drive position, the bowden wire cables 23 and 24 will urge the slide racks 35 and 45 to the left or to the right as seen from FIG. 3. This will cause the pinion gears 39 and 47 to rotate either clockwise or counterclockwise at half the speed of the slide racks 35 and 45. The pinion gears 39 and 47 will move in the same direction as their associated slide rack 35 or 45 along the associated upper slide rack 36 or 46 which remain stationary when operator 21 is used to control the throttle and transmission of the outboard drive unit 13.

The rotation of pinion gear 47 is then transferred to the lever arm 49 through the link 48 to rotate the arm 49 about the shaft 51. Pivotal movement of the lever arm 49, in turn, effects movement of the throttle actuator 18 through the inner wire of cable 28 to open the throttle valve on the engine 14.

On the other hand, rotation of pinion gear 39 is transmitted to the pin 40 through the connecting links 41 and 42. This position detector 43 detects the rotation of the pin 40 and converts it into a voltage which, as previously noted, corresponds to the rotational position of the pin 40 as well as to the rotational position of the operator 21 in this instance. An electrical voltage signal V1 is then transmitted by the detector 43 to the controlling unit 44 through the wire harness 29. The controlling unit 44 also receives an electrical voltage signal V2 from the detector 56 indicative of the position of the shift actuator 19 which is connected to the potentiometer arm 57 by means of the inner wire of cable 32 and the slide rack 52. The position detectors 43 and 56 output their voltage signals to respective input circuits whereafter the signals are digitized in an A/D converter and transmitted to a microcomputer unit 61 of the controlling unit 44. The microcomputer 61 also receives input signals from a crank angle sensor 62 through an input circuit. Based on these input signals, the microcomputer 61 controls the operation of the motor driven actuator 55 and a capacitor discharge ignition (CDI) interrupt circuit 63 which, when actuated, acts to interrupt the spark firing or fuel injection.

The microprocessor 61, which includes a comparator, compares the electrical voltage signals V1 and V2, and when there is a difference, it transmits a difference signal through an output circuit to the motor driven actuator 55 for controlling its operation to null the difference signal. That is, upon receipt of this difference signal, the motor driven actuator 55 is operated so that the present position of the slide rack 52, and hence the position of the shift actuator 19, corresponds with the position of the operator 21. When the motor driven actuator 55 is operated in this manner, it drives the pinion gear 54 which causes the slide rack 52 to move along its guide to effect a pushing or pulling movement on the inner wire of shift cable 32 so as to effect movement of the shift actuator 19.

When there is a difference between the voltage signals V1 and V2 and when the signals from the crank angle sensor 62 indicate that the engine speed is greater than a predetermined value, the microprocessor 61 also outputs a signal to the interrupt circuit 63 through an output circuit to interrupt the spark firing or fuel injection of the engine until the gear shifting operation is complete.

Figure 5:
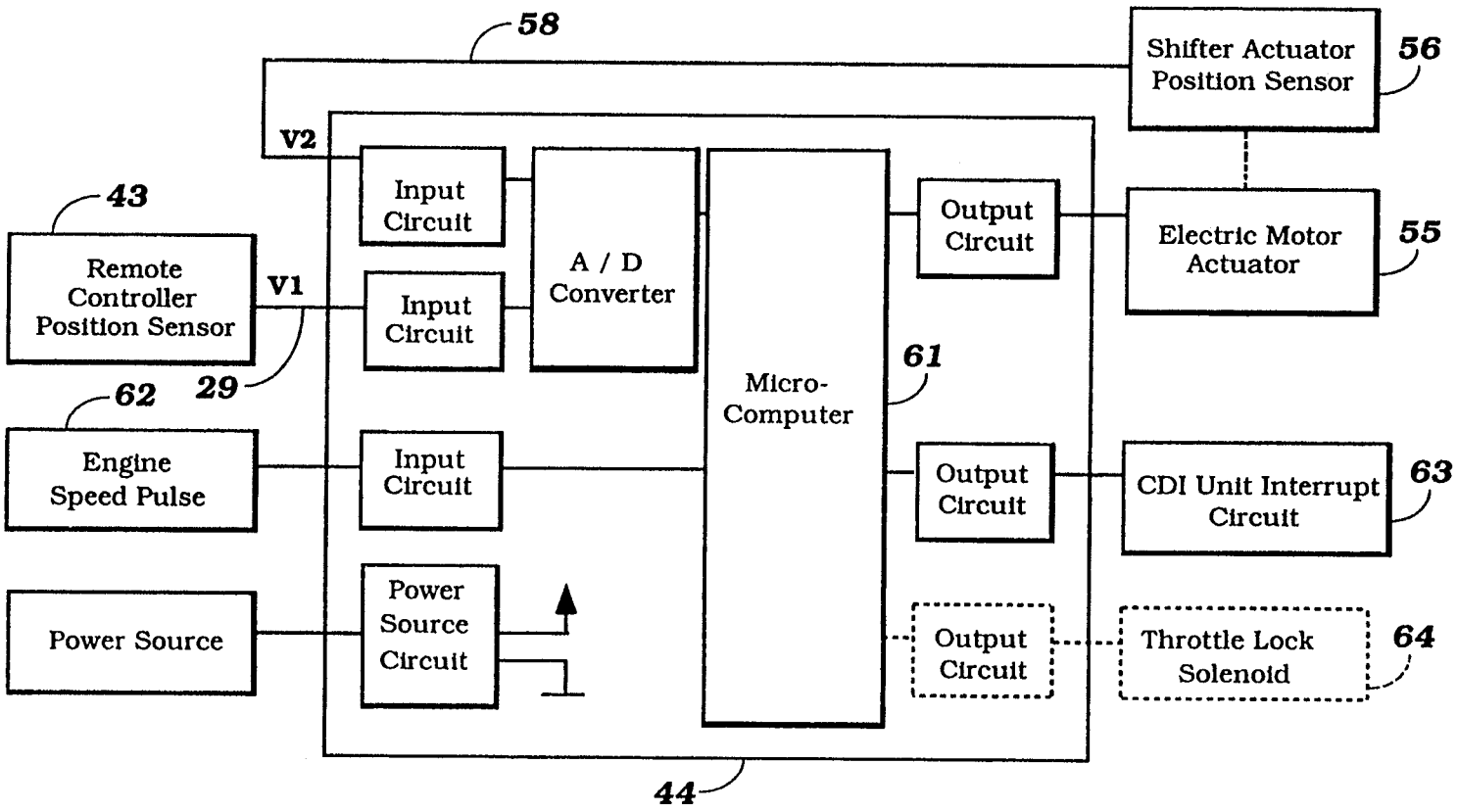
FIG. 5 is a schematic diagram showing the relationship between the various sensors and the controlling unit of the driving unit.

It should be noted that other types of speed restraining means, such as a throttle lock solenoid 64 shown in FIG. 5 in phantom lines, may be employed instead of the ignition interrupt circuit 63. When used, the throttle lock solenoid 64 acts to lock the throttle actuator 18 in a certain position corresponding to a predetermined engine speed during the control process when the throttle lock solenoid 64 receives a signal from the microprocessor 61 through an output circuit also shown in phantom in FIG. 5.

The throttle and shift actuators 18 and 19 may also be controlled using operator 22 when it is selected. Control of the system using operator 22 is similar to that described above with respect to operator 21, except that in this case, movement of the operator 22 causes movement of bowden wire cables 25 and 26 to urge slide racks 36 and 46 leftward or rightward while the slide racks 35 and 36 remain stationary.

Figure 6:
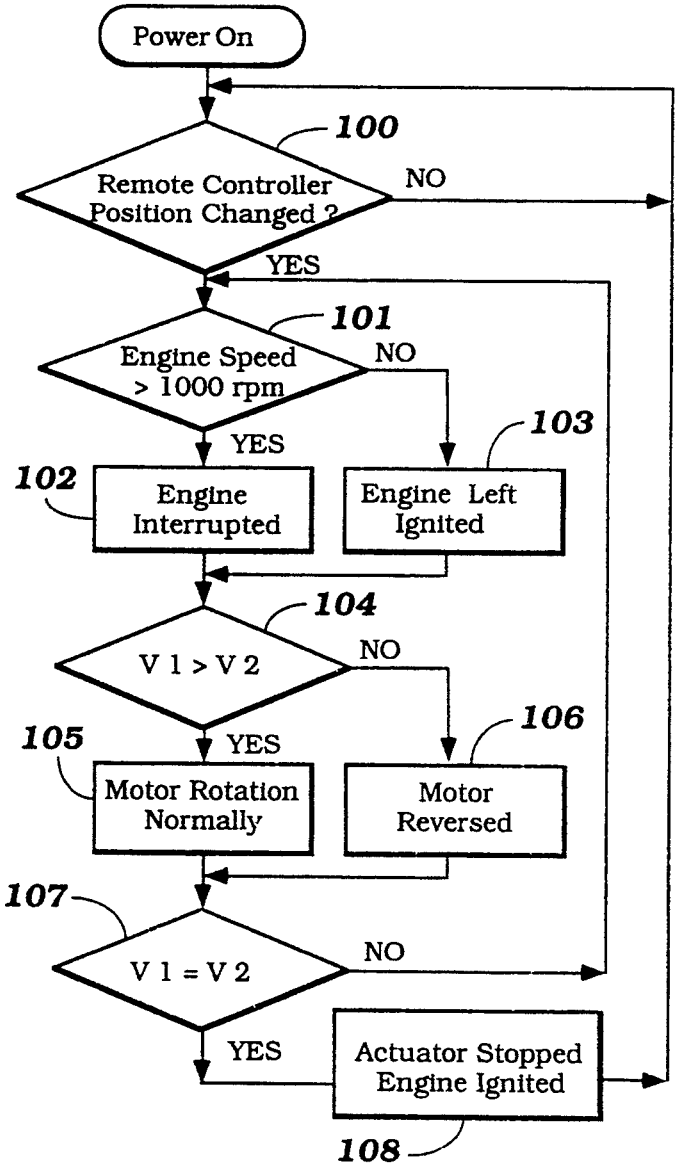
FIG. 6 is a flow chart showing an operation of the remote control system.

The operation of the remote control system will now be described with particular reference to the flow chart shown in FIG. 6. When the power is turned on, the position detector 43 detects the position of the selected operator 21 or 22 in step 100 at regular time intervals. If the position is unchanged, the program returns to step 100. However, if it is found that the position of the selected operator 21 or 22 has changed, the program proceeds to step 101 where the microcomputer 61 computes the engine speed from the input data received from the crank angle sensor 62. If the calculated engine speed is greater than 1000 rpm, for example, the program is advanced to step 102 to actuate the CDI interrupt circuit 63 to interrupt the ignition or fuel injection of the engine 14. If, on the other hand, the calculated engine speed does not exceed 1000 rpm, the program proceeds from step 101 to step 103 wherein the CDI interrupt circuit 63 is not actuated so that the engine speed can rise. This will normally have the effect of maintaining the engine speed at or about the predetermined value, which is 1000 rpm in the illustrated embodiment, during movement of the selected operator 21 or 22.

At the next step 104, the output voltage V1 of the position detector 43 is compared with the output voltage V2 of the position detector 56. When V1 is greater than V2, the motor driven actuator 55 is rotated in one direction in step 105, whereas when V1 is not greater than V2, the motor driven actuator 55 is operated in the reverse direction in step 106, to make the position of the shift actuator 19 coincide with the position of the selected operator 21 or 22. In step 107, the microcomputer 61 determines whether or not V1 is equal to V2. If the answer is "yes," operation of the actuator 55 is stopped and the ignition is returned to its normal state in step 108. The program then returns to step 100. If, on the other hand, the answer to the decision in step 107 is "no," the program returns to step 101 where the engine speed is determined.

Figure 7:
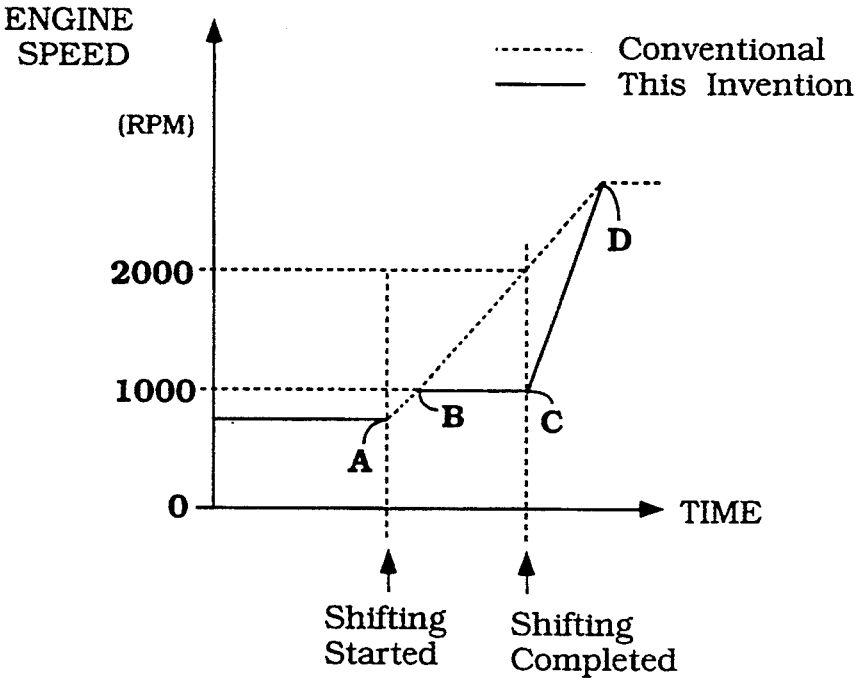
FIG. 7 is a graph illustrating the relationship between the shifting time and the engine speed in a conventional system and in this invention.

FIG. 7 graphically illustrates the relationship between the remote control operation and the engine speed. If the selected operator 21 or 22 is abruptly moved from its neutral position to a forward drive position while the engine is idling at point A, the throttle actuator 18 is adjusted abruptly to open the throttle valve on the engine 14 wherein the engine speed begins to rise suddenly. The shift actuator 19, however, is not adjusted immediately following the abrupt movement of the operator 21 or 22. Instead, there is some time delay while the electrical signals are processed. During this time delay, there will be some difference detected between the position of the operator 21 or 22 and the position of the shift actuator 19. When this difference in position is detected, the engine speed will be permitted to rise to only 1000 rpm (point B) where it will then be maintained by the interrupt circuit 63 until the shifting operation is completed, even if the throttle valve is opened an amount that would otherwise produce a higher engine speed. That is, when the engine speed exceeds 1000 rpm the interrupt circuit 63 is actuated to reduce the engine speed to a constant 1000 rpm and when the engine speed is less than 1000 rpm the circuit 63 is turned off to allow the engine speed to increase. By not allowing the engine speed to exceed 1000 rpm, the shifting operation is able to proceed smoothly.

When the difference in position between the selected operator 21 or 22 and shift actuator 19 is eliminated (that is, when V1 equals V2), the interrupt circuit 63 is shut off and the engine 14 is then ignited normally at point C. At the same time, the motor drive actuator 55 is also brought to a stop and the shift actuator 19 is maintained at its adjusted position. The engine speed is then permitted to rise naturally and return to its normal operational speed at point D.

Figure 8:
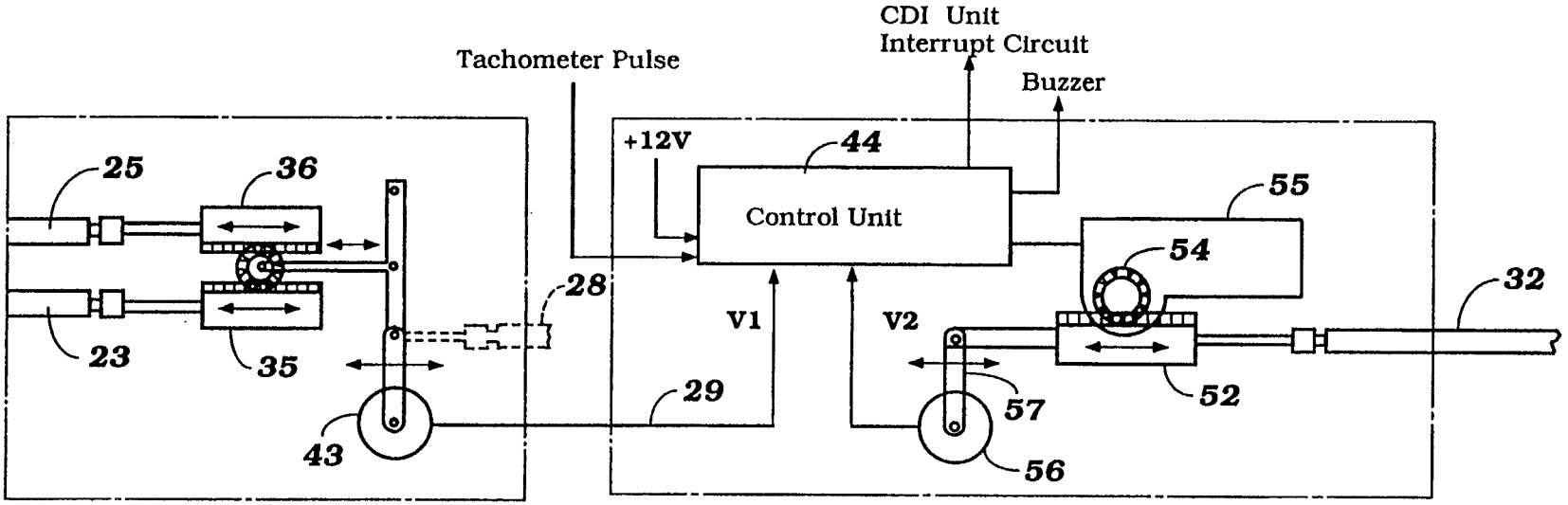
FIG. 8 is a schematic view showing an alternative construction of the actuator unit and the driving unit.

FIG. 8 illustrates alternative constructions for the actuator and driving units 27 and 31. In addition to the outputs to the electric motor actuator 55 and interrupt circuit 63, the controlling unit 44 may also be adapted to output a signal to a buzzer in the event there exists some abnormality in the system.

It should be readily apparent from the foregoing description that a remote control system for controlling the throttle and transmission of an outboard drive unit from one or the other of a pair of operators has been illustrated and described which provides very responsive throttle control, as well as smooth gear shifting operation even when the selected operator is abruptly moved. When the selected operator is abruptly moved, the throttle valve is immediately adjusted but the engine speed is not permitted to exceed a relatively low rpm until the transmission is shifted into the appropriate gear. Thereafter, when the gear shifting is completed, the engine speed is permitted to rise normally. Although embodiments of the invention have been illustrated and described, various modifications may be made without departing from the spirit and scope of the invention as defined by the appended claims.

For example, although the position of the operators 21 and 22 are detected indirectly through bowden wire cables, the positions of the operators 21 and 22 may also be detected directly. In addition, the detectors 43 and 56 need not employ a potentiometer but may instead employ other known types of devices for detecting the position of a movable member.

I claim:

1. A remote control system for transmitting control movement to at least two controlled members of an outboard drive unit having an engine comprising an actuator unit, a remote control unit having an operator movable between a plurality of positions and mechanically connected to said actuator unit, a transmitter mechanically connecting said actuator unit to one of said controlled members for actuating it in response to movement of said operator, a controlling unit, means for detecting the position of said operator and outputting a signal to said controlling unit indicative of the detected position of said operator, electric actuating means electrically connected to said controlling unit for actuating said other controlled member on the basis of the signal received by said controlling unit, and means electrically connected to said controlling unit for interrupting the engine operation when the engine speed is determined to be greater than a predetermined value and when the signal outputted by said detecting means indicates a change in the position of said operator.

2. A remote control system as recited in claim 1, further comprising means for detecting the position of the other of said controlled members and outputting a signal to said controlling unit indicative of the detected position of said other controlled member, and wherein said electric actuating means actuates said other controlled member on the basis of the signals received by said controlling unit from said first and second detecting means and wherein said interrupt circuit interrupts the engine operation when the engine speed is determined to be greater than the predetermined value and when the signals received by said controlling unit from said first and second detecting means are not equal.

3. A remote control system as recited in claim 2, wherein said controlling unit comprises a microprocessor for comparing the signals received from said first and second detecting means and outputting a difference signal to said electric actuating means for controlling its operation to null the difference signal.

4. A remote control system as recited in claim 1, wherein said engine operation interrupting means comprises an interrupt circuit.

5. A remote control system as recited in claim 4, wherein said interrupt circuit interrupts the spark firing of the engine.

6. A remote control system as recited in claim 1, wherein said engine operation interrupting means comprises a throttle lock solenoid.

7. A remote control system for transmitting control movement to at least two controlled members of an outboard drive unit having an engine comprising an actuator unit, a pair of remote control units each having an operator movable between a plurality of positions and mechanically connected to said actuator unit, one or the other of said remote control units and its associated operator being selected for transmitting control movement at a time, a transmitter mechanically connecting said actuator unit to one of said controlled members for actuating it in response to movement of said selected operator, a controlling unit, means for detecting the position of said selected operator and outputting a signal to said controlling unit indicative of the detected position of said selected operator, electric actuating means electrically connected to said controlling unit for actuating said other controlled member on the basis of the signal received by said controlling unit, and means electrically connected to said controlling unit for interrupting the engine operation when the engine speed is determined to be greater than a predetermined value and when the signal outputted by said detecting means indicates a change in the position of said selected operator.

8. A remote control system as recited in claim 7, further comprising means for detecting the position of the other of said controlled members and outputting a signal to said controlling unit indicative of the detected position of said other controlled member, and wherein said electric actuating means actuates said other controlled member on the basis of the signals received by said controlling unit from said first and second detecting means and wherein said interrupt circuit interrupts the engine operation when the engine speed is determined to be greater than the predetermined value and when the signals received by said controlling unit from said first and second detecting means are not equal.

9. A remote control system as recited in claim 8, wherein said controlling unit comprises a microprocessor for comparing the signals received from said first and second detecting means and outputting a difference signal to said electric actuating means for controlling its operation to null the difference signal.

10. A remote control system as recited in claim 7, wherein said engine operation interrupting means comprises an interrupt circuit.

11. A remote control system as recited in claim 10, wherein said interrupt circuit interrupts the spark firing of the engine.

12. A remote control system as recited in claim 7, wherein said engine operation interrupting means comprises a throttle lock solenoid.

* * * * *